US005596786A

United States Patent [19]

Kluiters

[11] Patent Number: 5,596,786

[45] Date of Patent: Jan. 28, 1997

[54] TRIANGULAR SHAPED FLOOR MOP

[76] Inventor: Gam Kluiters, 132 Greenpoint Ave., 3rd Floor, Brooklyn, N.Y. 11222

[21] Appl. No.: 488,903

[22] Filed: Jun. 9, 1995

[51] Int. Cl.[6] ..... A47L 13/14

[52] U.S. Cl. ..... 15/119.2; 15/244.1; 15/244.2

[58] Field of Search ..... 15/119.1, 119.2, 15/147.1, 228, 244.1, 244.2, 244.4

[56] References Cited

U.S. PATENT DOCUMENTS

| | | | |
|---|---|---|---|
| D. 274,856 | 7/1984 | Smith et al. . | |
| D. 281,635 | 12/1985 | Machaek et al. . | |
| D. 320,878 | 10/1991 | Linder . | |
| 2,741,787 | 4/1956 | Palma, Jr. | 15/119.2 |
| 2,996,743 | 8/1961 | Noble | 15/119.2 |
| 3,031,706 | 5/1962 | Daline | 15/119.2 |
| 3,171,152 | 3/1965 | Corcoran | 15/244.2 |
| 4,468,830 | 9/1984 | Batchelor . | |
| 4,654,920 | 4/1987 | O'Neil, Jr. et al. . | |
| 4,777,690 | 10/1988 | Ancier | 15/119.2 |

FOREIGN PATENT DOCUMENTS

| | | | |
|---|---|---|---|
| 0986772 | 8/1951 | France | 15/119.2 |
| 0151869 | 10/1955 | Sweden | 15/244.2 |
| 0243064 | 12/1946 | Switzerland | 15/119.2 |
| 0630503 | 10/1949 | United Kingdom | 15/244.2 |

*Primary Examiner*—David Scherbel
*Assistant Examiner*—Randall E. Chin
*Attorney, Agent, or Firm*—Richard L. Miller, P.E.

[57] ABSTRACT

The invention is a floor mop, comprising a mop head having a sponge. The sponge has a triangular cross section and a channel extending through the sponge. The mop head has a core which extends through the channel, the core triangular in shape. The core has two ends each having a core face, each core face having a center. A handle assembly is attached to the core, allowing the mop head to rotate about the core.

6 Claims, 4 Drawing Sheets

FIG. 1
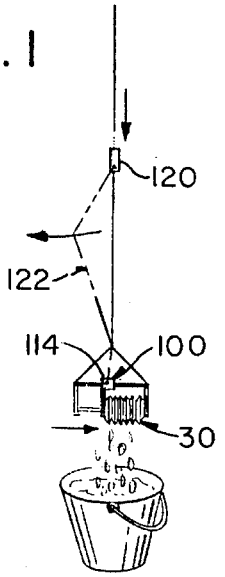
FIG. 2
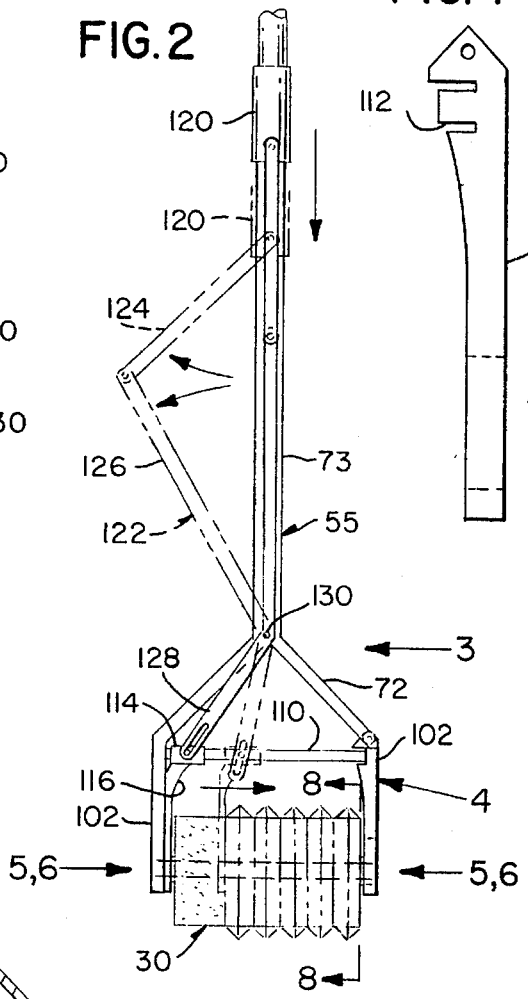
FIG. 4
FIG. 3
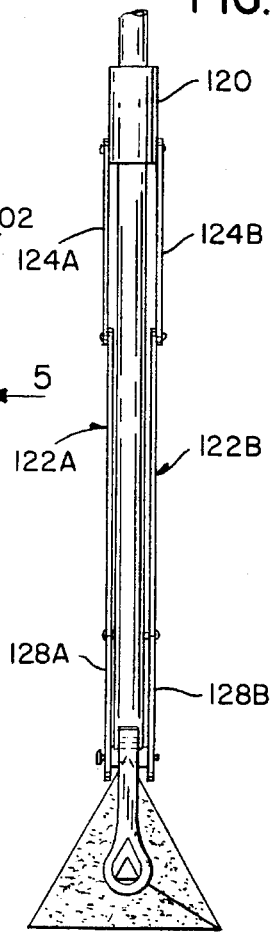
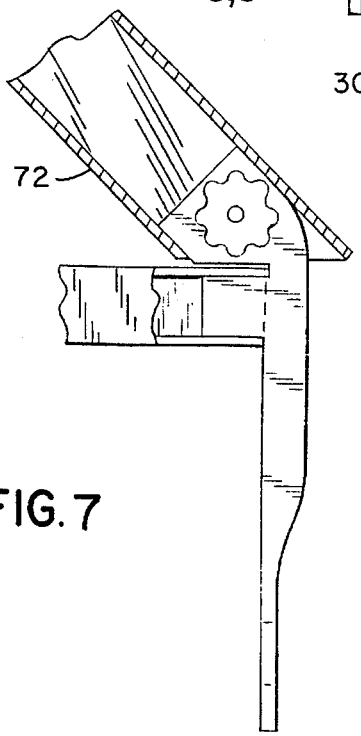
FIG. 7
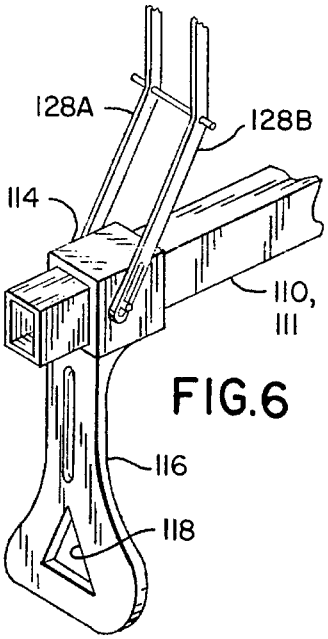
FIG. 6
FIG. 5
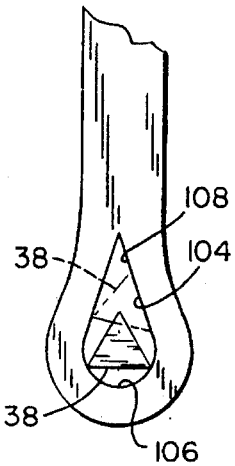

FIG. 8
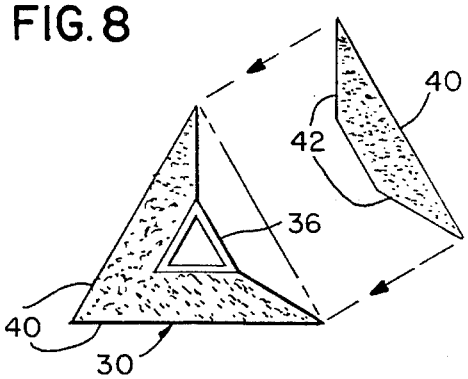
FIG. 11
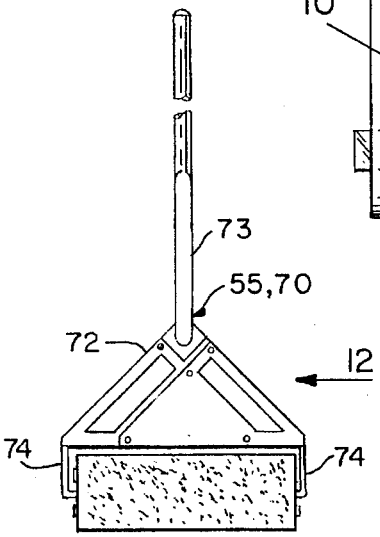
FIG. 9
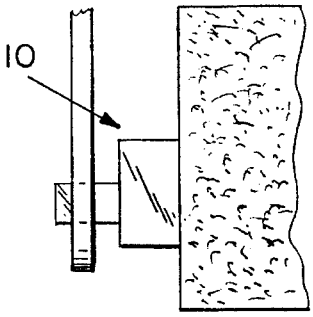
FIG. 10
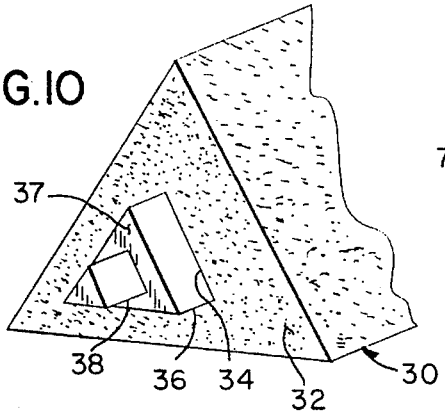
FIG. 12
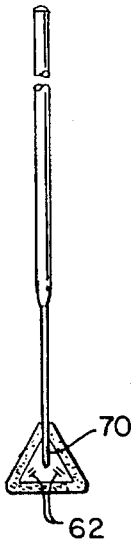
FIG. 13
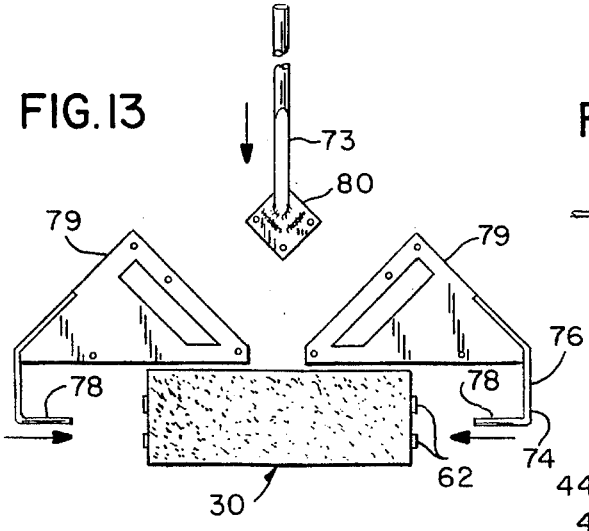
FIG. 17
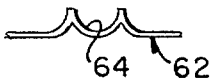
FIG. 14
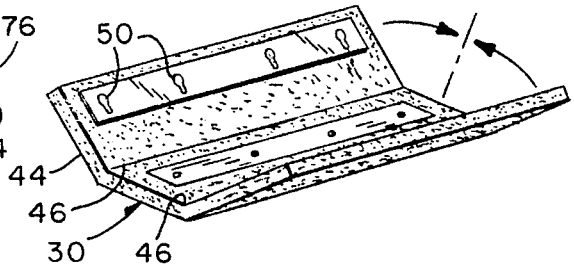
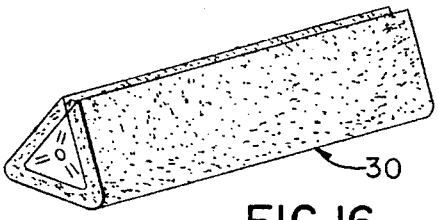
FIG. 16
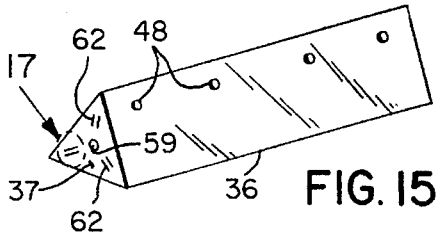
FIG. 15

FIG. 18
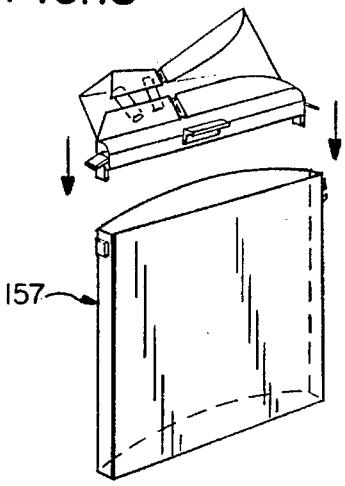
FIG. 19
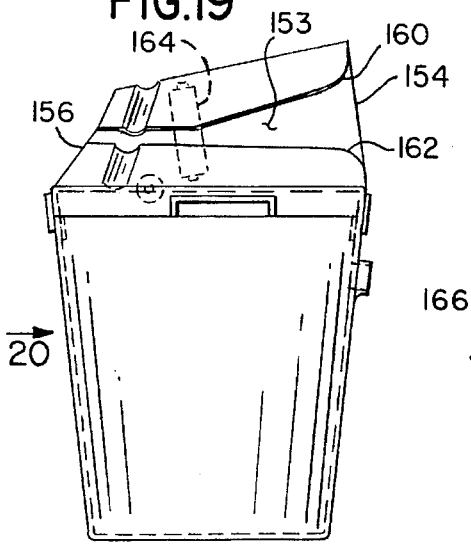
FIG. 20
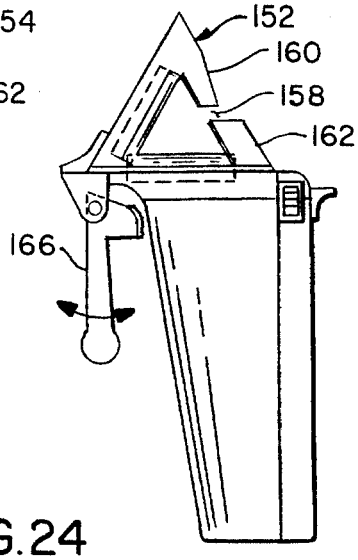
FIG. 21
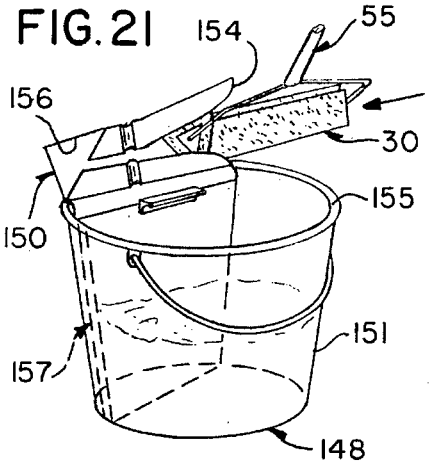
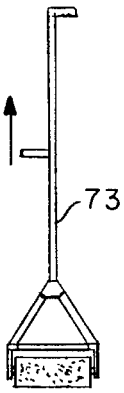
FIG. 23
FIG. 24
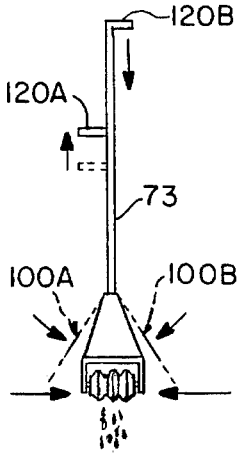
FIG. 22
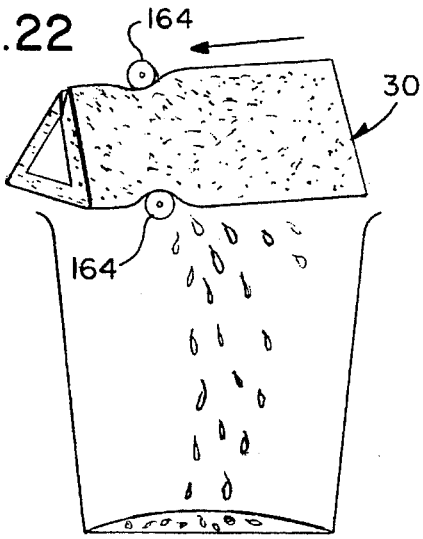
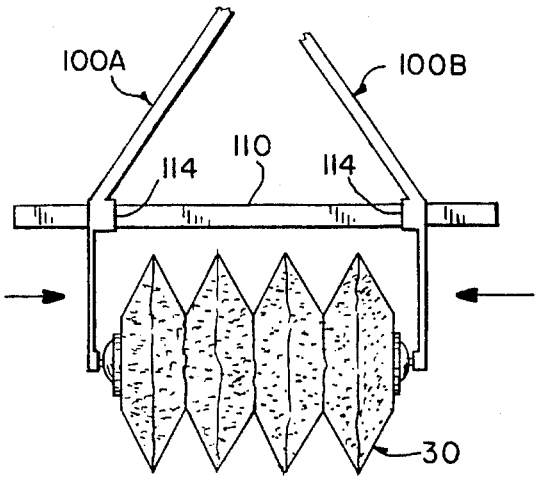
FIG. 25

FIG. 5A
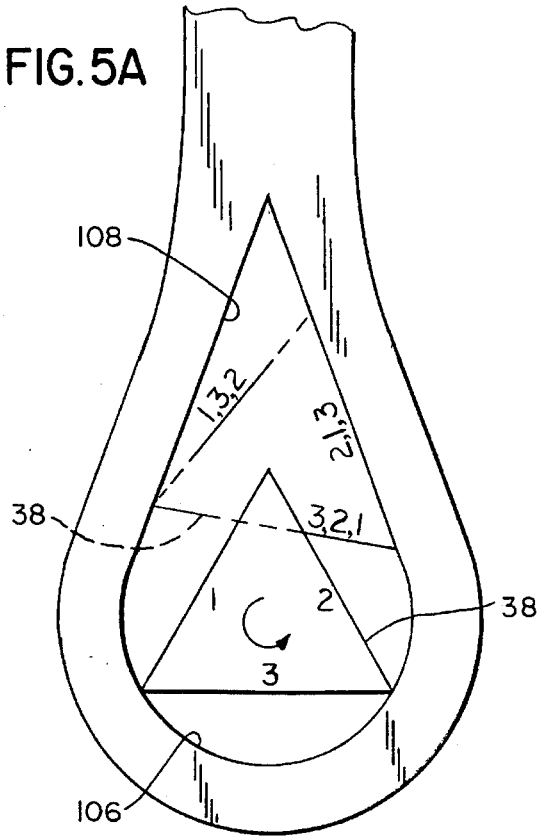
FIG. 5B
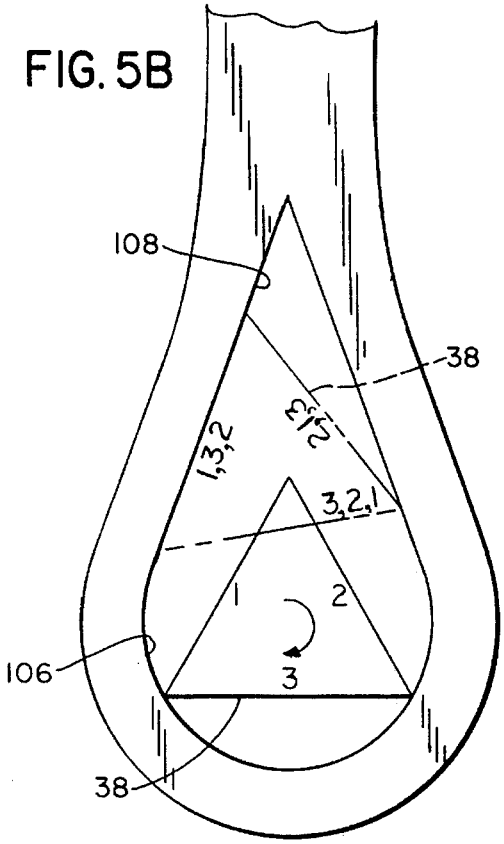
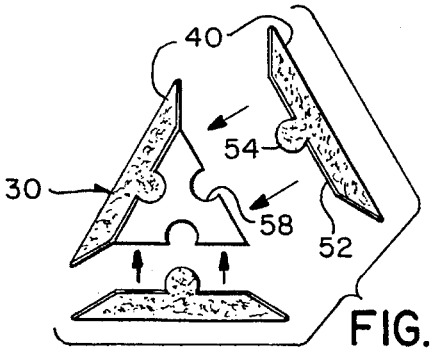
FIG. 26
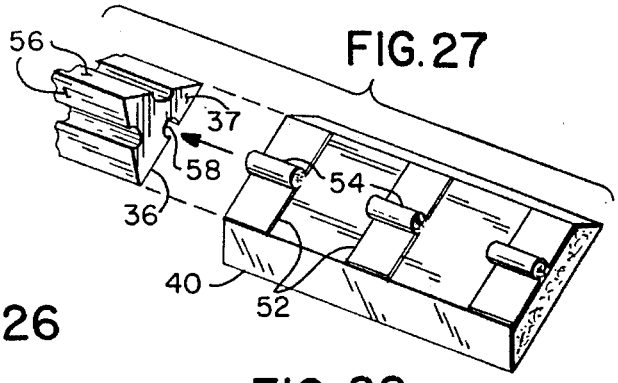
FIG. 27
FIG. 28
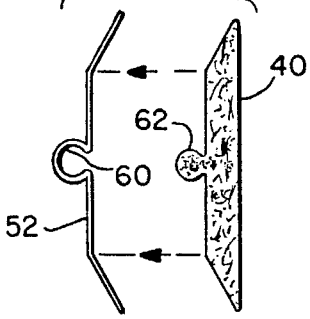
FIG. 29
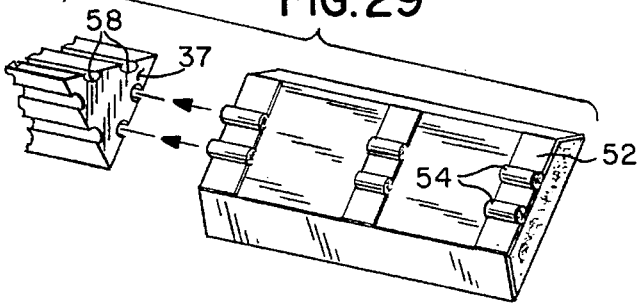

TRIANGULAR SHAPED FLOOR MOP

BACKGROUND OF THE INVENTION

The invention relates to a triangular shaped floor mop. More particularly, the invention relates to a mop having a squeezing mechanism capable of squeezing virtually all absorbed liquid out of a detachable sponge pad.

Mops with squeezing mechanisms are already known in the art, and have evolved into a variety of forms. In the typical squeeze mop construction, a mop is defined by a handle which carries a mop head at one end, the mop head carrying a sponge which is constructed such that the sponge may be squeezed or wrung out to ready it for a fresh infusion of cleaning liquid, or to rid it of dirty liquid. The problem with these embodiments, however, is that the sponge pad almost always comprises a sponge which is permanently affixed to a backing plate, said backing plate detachably fixed to the mop head. Because of this method of assembly, only one surface or face of the sponge is available for cleaning. With only one surface available to provide cleansing action, the sponge pad quickly collects dirt and/or loses its moisture, and must be continuously dipped in clean liquid and wrung out again. Illustrative of similar sponge mops is U.S. Pat. No. 4,468,830 to Batchelor.

While these units may be suitable for the particular purpose employed, or for general use, they would not be as suitable for the purposes of the present invention as disclosed hereafter.

SUMMARY OF THE INVENTION

It is an object of the invention to produce a mop which may be used to perform the dual function of washing a floor in a traditional fashion, and also removing soil which would normally be resistant to a standard mop by utilizing the large surface area contact of the mop head.

It is another object of the invention to provide a mop having a mop head which has more than one surface available to contact and clean the floor, such that as one surface of the mop head becomes overloaded with collected dirt, the mop head may simply be rotated so that a clean, moist surface of its sponge contacts the floor. Accordingly, there is no need to continuously dip the sponge in clean liquid and wring it out.

The invention is a floor mop, comprising a mop head having a sponge. The sponge has a triangular cross section and a channel extending through the sponge. The mop head has a core which extends through the channel, the core triangular in shape. The core has two ends each having a core face, each core face having a center. A handle assembly is attached to the core, allowing the mop head to rotate about the core.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

FIG. 1 is a diagrammatic perspective view of the instant invention;

FIG. 2 is an enlarged diagrammatic plan view illustrated in FIG. 1 shown in greater detail;

FIG. 3 is a side elevational view taken on arrow 3 in FIG. 2;

FIG. 4 is an enlarged elevational view illustrating the part indicated by arrow 4 per se in FIG. 2;

FIG. 5 is an enlarged diagrammatic partial view taken in the direction of arrow 5 in FIGS. 2 and 4 of a first embodiment of the instant invention;

FIG. 5A and 5B are diagrammatic partial views illustrating the alternate positions in which the mop head can be rotated;

FIG. 6 is an enlarged diagrammatic perspective view taken generally in the direction of arrow 6 in FIG. 2 illustrating the wring guide of a second embodiment of the instant invention;

FIG. 7 is an enlarged diagrammatic plan view of the fixed member side of the instant invention;

FIG. 8 is an enlarged side elevational view taken on line 8—8 of FIG. 2 illustrating the fabricating of the mop head;

FIG. 9 is an enlarged diagrammatic partial view of a third embodiment illustrating an alternate securing means for the mop of the instant invention;

FIG. 10 is a diagrammatic perspective view taken generally in the direction of arrow 10 in FIG. 9 with parts broken away;

FIG. 11 is an elevational view of a fourth embodiment of the instant invention;

FIG. 12 is a side elevational view taken in the direction of arrow 12 in FIG. 11;

FIG. 13 is an exploded diagrammatic perspective view of the embodiment illustrated in FIG. 11;

FIG. 14 is an enlarged diagrammatic perspective view illustrating the outer sponge construction with plates attached thereto for holding to a core;

FIG. 15 is a diagrammatic perspective view of a preformed core component;

FIG. 16 is a diagrammatic perspective view illustrating the sponge component secured to the preformed core component;

FIG. 17 is an enlarged diagrammatic view illustrating a clip for locking the rotational position of the mop of the fourth embodiment of the instant invention;

FIG. 18 is a diagrammatic perspective view illustrating a bucket insert for removing water from the triangular shaped mop of the instant invention;

FIG. 19 is a diagrammatic elevational view thereof;

FIG. 20 is a diagrammatic side elevational view taken in the direction of arrow 20 in FIG. 19 which illustrates a locking mechanism for securing the bucket insert in a typical bucket;

FIG. 21 is a diagrammatic perspective view further illustrating the bucket insert fixed to a typical pail;

FIG. 22 is an enlarged diagrammatic perspective view, with parts broken away, illustrating how rollers are used to squeeze liquid from the mop head;

FIG. 23 is a diagrammatic plan view of a fifth embodiment of the wringing mechanism;

FIG. 24 is a diagrammatic view thereof illustrating the mop compressed or squeezed;

FIG. 25 is an enlarged diagrammatic perspective view, with parts broken away, showing further construction details thereof;

FIG. 26 is an enlarged diagrammatic exploded perspective view illustrating an alternate embodiment of the mop head construction;

FIG. 27 is an enlarged diagrammatic perspective exploded view thereof;

FIG. 28 is an enlarged diagrammatic perspective view illustrating how the sponge slab is bonded to a back plate; and FIG. 29 is an enlarged diagrammatic perspective view illustrating yet another alternative embodiment of the mop head construction.

DETAILED DESCRIPTION OF THE PREFERRED EMBODIMENTS

FIG. 10 illustrates a mop head 30 having a sponge 32. The sponge 32 has a channel 34 extending therethrough. The mop head 30 further has a core 36 which extends through the channel 34. The sponge 32 has a triangular cross section. Further, the core 36 also has two ends, each having a core face 37 and a triangular cross section. The channel 34 has a cross section which matches that of the core 36.

A shaft 38 extends through the core. The shaft 38 extends slightly beyond the core face 37.

FIG. 8 shows an alternate construction for the mop head 30. The sponge comprises three sponge slabs 40. The sponge slabs 40 each have the shape of an extruded trapezoid, having a pair of nonparallel sides 42. The non-parallel sides of the sponge slabs 40 are brought together around the core 36, so that the three sponge slabs 40 form an extruded triangle around the core 36

FIG. 14 through FIG. 16 represent an alternate embodiment for the mop head 30. In this embodiment the sponge 32 is initially in the form of a sheet 44. The sheet 44 is scored twice to create two bend points 46. The sheet 44 may then be bent about the bend points 46, bringing opposite edges of the sheet together into the shape of a triangle. The core 36 in FIG. 15 has a plurality of posts 48 which correspond to post recesses 50 on the sheet 44, to attach the sheet around the core 36.

FIG. 26 through 29 present a still further example of how the mop head 30 may be constructed. In this embodiment, each sponge slab 40 has several back plates 52 spaced along the sponge slab 40. Each back plate has a rib 54. The ribs 54 on each back plate 52 extend in a straight line. The core 36 has three core sides 56. In this embodiment, the core 36 has a rib recess 58 on each of the core sides 56. The rib recesses 58 extend between the core faces 37, and extend parallel to one another. Referring to FIG. 26, to construct the mop head 30, each sponge slab 40 is brought into close proximity with the core 36, such that the ribs 54 on the back plates 52 extend into the rib recesses 58 on one of the core sides 56. The other two sponge slabs 40 are similarly mated with the other two core faces 37 to produce a triangular structure.

FIG. 28 illustrates a preferred method of attaching the backplate 52 to the sponge slab 40. The back plate 52 has a u-bend 60, which comprises the rib 54. However, the sponge slab 40 has a tubular extension 62 which mates within the u-bend 60 to attach the back plate 52 to the sponge slab 40.

FIG. 29 is a variation on the mop head 30 of FIG. 26 through FIG. 28. According to this variation, each back plate 52 has two parallel ribs 54, and each core face 37 has two parallel rib recesses 58.

Thus, several different embodiments for producing a triangular mop head have been described. Below several different handle apparatus and wringing apparatus are disclosed.

FIG. 11 through FIG. 17 contemplate a handle assembly 55 suitable for use with the mop head 30 previously discussed in FIG 14 through 16. Referring back to FIG. 15, it can be seen that the handle assembly allows the mop head 30 to rotate about the core 36. The core face 37 is a triangle having three corners and a center midway between all three corners. An axle hole 59 extends into the center of each core face 37. The core face 37 also has three stop notches 62, each located near one of the corners, and each extending in a direction from one of the corners to the center of the core face 37. FIG. 17 details one of the stop notches 62 in a side view. The stop notch 62 is M-shaped, having a notch indent 64.

In FIG. 11, the handle assembly 55 is a fixed handle assembly 70. The fixed handle assembly 70 has a flared base 72, and a mast 73 extending from the flared base 72. The flared base 72 has a pair of end hooks 74. Each end hook 74 has a vertical portion 76 extending down from the flared base 72, and then is bent ninety degrees to form a horizontal portion 78 which extends inward toward the mop head 30. The horizontal portion 78 of each end hook 74 extends into the axle hole 59 to an extent that the vertical portion 76 is nearly flush with the core face 37, so that the vertical portion 76 can click into one of the stop notches 62 to keep the mop head 30 stationary, until sufficient force overcomes the stop notch 62 to rotate the mop head 30. FIG 12 is a side view, illustrating the vertical portion 76 in position in one of the stop notches 62.

FIG. 13 illustrates the construction of the flared base. The flared base 72 is comprised of two base triangles 79, each having one of the end hooks 74 extending therefrom. The base triangles 79 are brought together as the horizontal portion 78 of the end hooks 74 is inserted into the axle holes 59. A mast plate 80, attached to the mast 73, clamps the two base triangles 79 together at their apex, preventing the base triangles 79 from being pulled apart, and preventing the horizontal portion 78 from being pulled out of the axle holes 59.

Another embodiment of the handle assembly 55 is illustrated in FIG. 1 through FIG. 7. The handle assembly 55 has an integral wringing assembly 100. The flared base 72 has a pair of side panels 102, which extend downward on either side of the mop head 30 of the type illustrated in FIG. 10. Referring to FIG. 5, each side panel 102 has a shaft opening 104. The shaft 38 extends through each shaft opening 104. The shaft opening 104 is tear drop shaped, having a rounded portion 106 adjacent to and below a wedge shaped portion 108. The rounded portion 106 has a diameter that allows the shaft 38 to rotate within the rounded portion. However, if the shaft 38 is urged upward into the wedge shaped portion 108, the shaft 38 can no longer rotate. Thus, one could rotate the mop head 30 within the shaft opening 104 when pressure is not being exerted upon the mop head 30. However, when pressure is exerted upon the mop head 30 by the handle assembly 55, such as when the mop head 30 is in contact with floor surfaces, the mop head 30 cannot rotate.

When it is desired to rotate the mop head 30 to another surface, the mop head 30 is lifted off the floor surface to ensure that the shaft 38 is in the rounded portion 106 where the shaft 38 can rotate counterclockwise or clockwise as illustrated in FIG. 5A and FIG. 5B, respectively. The mop head 30 is rotated, and then the mop head 30 is restored to the floor, exerting upward pressure on the shaft 38, thereby urging the shaft 38 into the wedge shaped portion 108, where it cannot rotate.

The integral wringing assembly 100 is now described in detail. A wring guide bar 110 extends between the side panels 102, above the mop head 30. The wring bar 110 may be a hollow square cross-sectioned tube 111 as shown in FIG. 6, in which case, referring to FIG. 4, the side panels 102 would have a wring bar insert 112 that inserts into the tube 111 to support the integral wringing assembly 100.

Referring to FIG. 6, a wring guide 114 is slidably mounted on the wring guide bar 110. A wring arm 116 extends downward from the wring guide 114 for engaging the mop head 30 to be wrung. The wring arm 116 has a shaftway 118 which supports the shaft 38. The shaft 38 extends fully through the shaftway 118. The shaftway 118 may be triangular in shape, and is large enough to allow the shaft 38 to easily rotate therein, and is large enough to allow the core 36 to extend therethrough when the triangle of the core 36 is oriented with the triangle of the shaftway 118.

FIG. 1 illustrates the operation of the wringing assembly 100. A grip 120 operates a lever assembly 122, which forces the wring guide 114 inward to compress the mop head 30, thus releasing liquid trapped therein.

FIG. 2 details the lever assembly 122. The lever assembly 122 has an upper arm 124, a middle arm 126, and a lower arm 128. The upper arm 124 is pivotally attached to the grip 120, and the lower arm is pivotally attached to the wring guide 114. The upper arm 124 is pivotally attached to the middle arm 126. The lower arm 128 is attached to the middle arm 126 at a fixed obtuse angle, so that when the middle arm 126 is substantially vertical, the lower arm 128 is positioned so that the wring guide 114 is fully against one of the side panels 102.

The grip 120 is slidably mounted on the mast 73. It slides upward and downward on the mast 73 to operate the lever assembly 122. The mast has a pivot point 130 where the mast 73 meets the flared base 72. The middle arm 126 and lower arm 128 are attached at the pivot point 130, and pivot thereabout as a unit.

The wringing operation is commenced by pushing the grip 120 downward on the mast 73 causing the upper arm 124 and middle arm 126 to bow outward. This outward movement of the middle arm 126 causes the combination of the middle arm and lower arm to pivot about the pivot point 130, pushing the lower arm inward. The lower arm 128 moves the wring guide 114 and wring arm 116 inward along the wring guide bar 110. The wring arm 116 compresses the mop head 30.

Referring to FIG. 3 and FIG. 6, the lever assembly 122 can have two lever assembly halves 122A and 122B, each connected between the grip 120 and the wring guide 114. Thus each component in the lever assembly 122 has complementary components. Illustrative are the lower arm halves 128A and 128B, which are both attached to the wring guide 114. Further, upper arm halves 124A and 124B are both attached to the grip 120.

Referring to FIG. 23 through FIG. 25, in a further embodiment, the integral wringing assembly 100 can comprise a primary wringing assembly 100A and a secondary wringing assembly 100B. Each wringing assembly has a wring guide 114 that travels along a common wring bar 110 toward the other wring guide 114 during the wringing operation to compress the mop head 30 from both ends. The secondary lever assembly 100B may be arranged so that a secondary grip 120B is mounted on the mast 73 with a primary grip 120A. In this embodiment, the grips 120A and 120B actuate the primary and secondary wringing assemblies 100A and 100B when they are pushed and pulled toward one another.

FIG. 18 through FIG. 22 illustrate a bucket insert 150. The bucket insert 150 is for use with a bucket 48 having a bucket wall 151, and a lip 155 on top of the bucket wall 151. The bucket insert 150 rests upon the lip 155. The bucket insert 150 has a base 157 which extends into the bucket, and is form fitting with the bucket wall 151.

The bucket insert 150 has a jaw 152 having an upper jaw 160 and a lower jaw 162. The jaw 152 has a canal 153 having an entrance 154 and an exit 156. The canal 153 is triangular in shape at the exit 156, and at the exit 156 it is substantially the same size as the cross section of the mop head 30. The canal 153 is larger at the entrance than the exit. The jaw 152 has a slot 158 between the upper jaw 160 and lower jaw 162. The slot 158 extends from the entrance 154 to the exit 156.

Wringing the mop head 30 is performed by swiping the mop head 30 through the canal 153. In other words, the mop head is pushed into the canal 153 at the entrance 154. The mop head 30 is compressed as the mop head 30 travels in the ever narrowing canal 153 toward the exit 156. The handle assembly 55 moves through the slot 158 as the mop travels through the canal 153. The mop head 30 can be pushed fully through the canal 153 and out the exit 156, or it can be withdrawn at the entrance 154 once the mop head 30 has been wrung sufficiently.

The bucket insert 150 also has rollers 164 disposed inside the canal 153 for helping to wring the mop head 30. The bucket insert 150 has an actuating rod 166 for compressing the upper jaw 160 toward the lower jaw 162 to narrow the canal and/or for pressing the rollers 164 upon the mop head 30.

What is claimed is:

1. A floor mop, comprising:

a) a mop head having a sponge, the sponge having a triangular cross section and a channel extending through the sponge, the mop head having a core which extends through the channel, the core being triangular in shape, the core having two ends, each end having a core face, each core face having a center, the core further comprising a shaft, extending through the core past both core faces, and b) a handle assembly, attached to the core, allowing the mop head to rotate with the core, the handle assembly comprising a mast and a flared base attached to the mast, the flared base comprising two side panels, the side panels comprising a shaft opening, the shaft openings are tear drop shaped, having a rounded portion and a wedge shaped portion, the rounded portion immediately below and adjacent to the wedge shaped portion, the shaft extending through the shaft openings.

2. The apparatus as recited in claim 1, wherein the rounded portion is of a diameter that allows the shaft to rotate therein.

3. The apparatus as recited in claim 1, wherein the apparatus further has an integral wringing assembly, comprising:

a) a wring guide bar extending between the side panels;

b) a wring guide, slidably mounted on the wring guide bar;

c) a wring arm extending downward from the wring guide for compressing the mop head; and a lever assembly attached to the wring guide.

4. The apparatus as recited in claim 3, further comprising a grip slidably mounted on the mast, the grip actuating the lever assembly.

5. The apparatus as recited in claim 4, wherein the handle assembly further comprises a pivot point, located at the point where the mast is attached to the flared base, and the lever assembly further comprises:

a) an upper arm, the upper arm pivotally attached to the grip;

b) a middle arm, the middle arm pivotally attached to the upper arm; and c) a lower arm, the lower arm rigidly attached to the middle arm at the pivot point, the lower arm forming an obtuse angle with the middle arm, the lower arm attached to the wring guide for moving the wring guide along the wring guide bar when the combination of the lower arm and middle arm is pivoted about the pivot point.

6. The apparatus as recited in claim 5, wherein the lever assembly further comprises two lever assembly halves, each connected between the grip and the wring guide.

* * * * *